United States Patent [19]

Foley

[11] Patent Number: 4,974,127

[45] Date of Patent: Nov. 27, 1990

[54] FLUIDIZED BED LAMP

[75] Inventor: James E. Foley, Ames, Iowa

[73] Assignee: Applied Thermodynamic Systems, Ames, Iowa

[21] Appl. No.: 497,980

[22] Filed: Mar. 23, 1990

[51] Int. Cl.[5] ..... F21Y 33/00

[52] U.S. Cl. ..... 362/96; 362/101; 362/318; 362/806

[58] Field of Search ..... 362/101, 96, 318, 806, 362/811

[56] References Cited

U.S. PATENT DOCUMENTS

| | | | |
|---|---|---|---|
| 3,711,698 | 1/1973 | Hess | 362/811 |
| 3,964,194 | 6/1976 | Gugeler | 362/96 |
| 3,995,151 | 11/1976 | Nordeen et al. | 362/96 |
| 4,020,337 | 4/1977 | Chatten | 362/234 |
| 4,190,312 | 2/1980 | Bailey | 362/96 |
| 4,609,974 | 9/1986 | Mori | 362/101 |

FOREIGN PATENT DOCUMENTS

| | | | |
|---|---|---|---|
| 491306 | 4/1929 | Fed. Rep. of Germany | 362/96 |

*Primary Examiner*—Ira S. Lazarus
*Assistant Examiner*—Richard R. Cole
*Attorney, Agent, or Firm*—Kent A. Herink

[57] ABSTRACT

A fluidized bed lamp which provides a pleasing visual and audible display. A bed of particles is contained within an outside tube and supported by a distribution plate. A liquid is pumped through the bed of particles, causing the bed to be in a state of fluidization. Fluidization is characterized by the bed behaving as a suspension with the particles moving about in a chaotic manner. The liquid is returned to the pump with a downcomer tube. The fluidized bed of particles is illuminated with a light fixture contained within the downcomer tube or by lights on the top or bottom of the lamp assembly.

5 Claims, 2 Drawing Sheets

FLUIDIZED BED LAMP

BACKGROUND OF THE INVENTION

1. Field of the Invention

This invention relates to lamps, and more specifically, a lamp incorporating a fluidized bed of particles.

2. Prior Art

Fluidized bed lamps are unknown in the prior art. An ornamental bubble lamp, described in U.S. Pat. No. 4,020,337, shares some similarities to the present fluidized bed lamp invention. The fluidized bed lamp is distinguished from the prior art by the unique chaotic motion and associated audible sounds of the fluidized bed of particles, and the light reflections and transmissions through the bed of particles. Also, the lamp has educational value in displaying the qualitative behavior of the fluidized bed principle; a principle widely used in the chemical and combustion industries.

SUMMARY OF THE INVENTION

In accordance with the invention, the lamp comprises a base containing a pump, an outer tube containing a bed of glass beads, an inner tube which carries water from the outer tube back to the pump, and a third tube, which is contained inside the inner tube, containing a string of lamps. In operation, the pump directs water through a plenum chamber, through a distribution plate, and vertically upward through the outer tube. The water flows through the bed of glass beads contained within the outer tube and causes the bed of beads to be in a state of fluidization. The water then passes from the outer tube into the inner tube and returns to the pump for recirculation. Light provided by the lamps contained within the inner tube is transmitted and reflected through the fluidized bed of glass beads.

The principal object of this invention is to provide a unique lamp which results in a pleasing visual and audible display.

Another object of this invention is to provide a means to exhibit the unique circulation and flow patterns existing in a fluidized bed of particles.

These and other objects and features of this invention will become more apparent with reference to the accompanying drawings, specification, and claims.

DETAILED DESCRIPTION OF A PREFERRED EMBODIMENT

Figure 1:
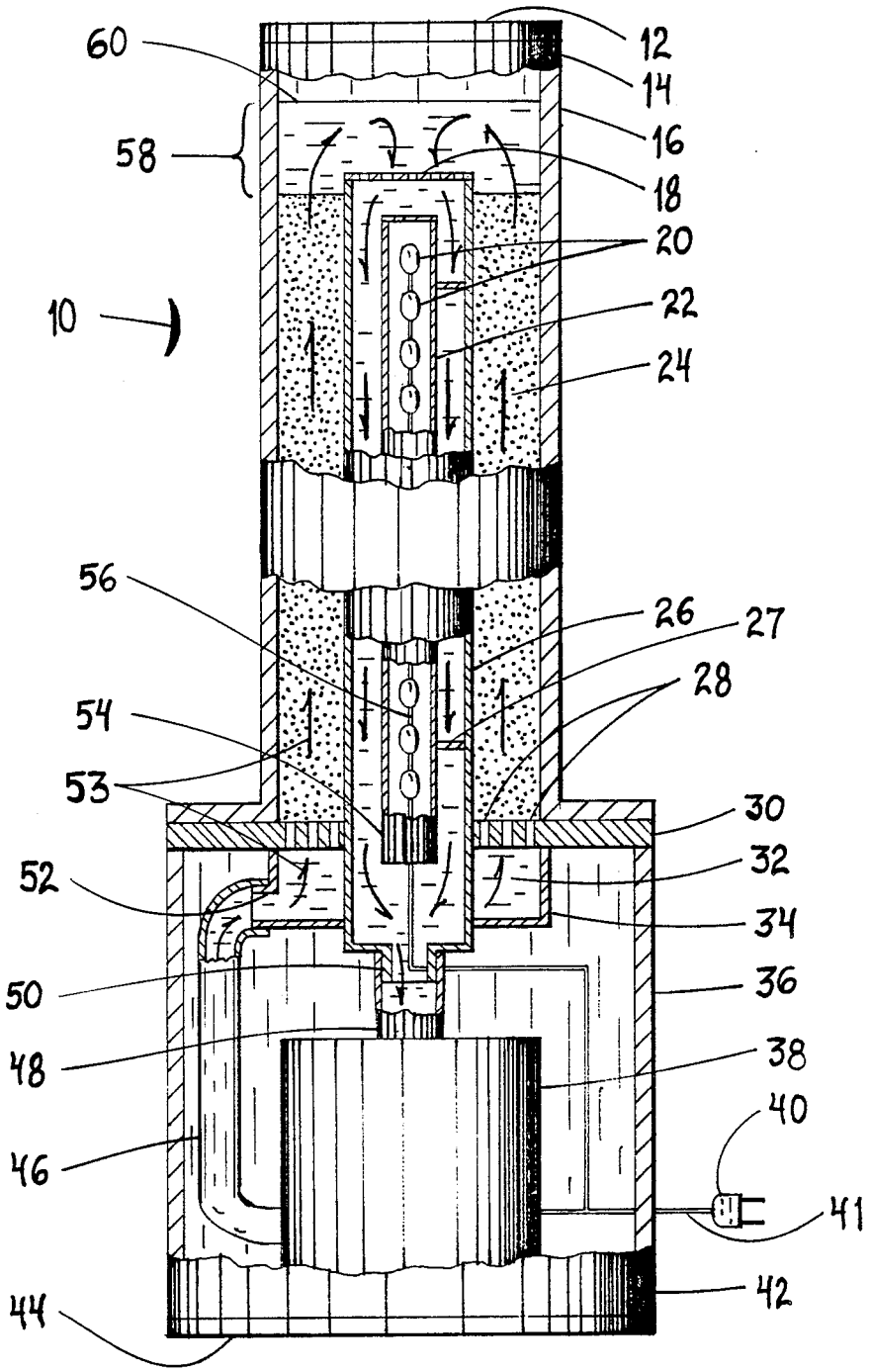
FIG. 1 is a sectional elevation of one embodiment of the fluidized bed lamp invention, with the section taken substantially along the line 1—1 as shown in FIG. 2.

With reference to the accompanying drawings included as FIGS. 1 and 2, a preferred embodiment of the invention will now be described. Most elements of the preferred embodiment will be designated by reference numerals as indicated on FIG. 1.

Figure 2:
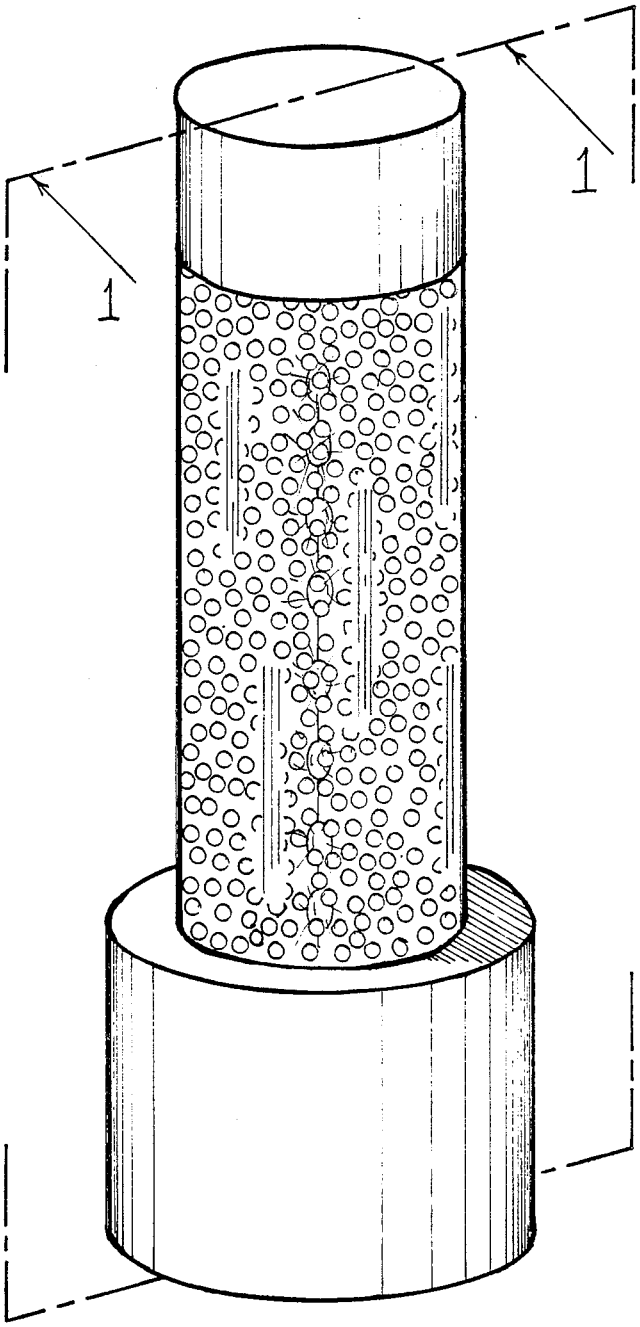
FIG. 2 is a perspective view of the fluidized bed lamp.

FIG. 1 illustrates a sectional elevation view of fluidized bed lamp 10. A bed of particles 24 is contained within outside enclosure 14. Enclosure 14 is defined by continuous tube wall 16, top wall 12, and distribution plate 30. The outside tube wall 16 is generally transparent so as to allow visual observation of the bed of particles 24. The bed of particles is contained outside of downcomer tube 26. A screen 18 is affixed to the top of the downcomer tube 26 to prevent said particles from infiltrating tube 26.

Base assembly 42 is comprised of continuous tube side wall 36, bottom wall 44, and distribution plate 30. Plenum chamber 34 is affixed to the bottom of distribution plate 30. Distribution plate 30 prevents the particles from infiltrating the plenum chamber 34 while allowing liquid 32 to pass through upwardly into the bed of particles 24. Plate 30 can either have a large number of perforations 28, or can be constructed of a porous material. Downcomer tube 26 extends vertically through distribution plate 30 and the plenum chamber 34. Pump 38 rests on the bottom wall 44 of base assembly 42.

Illuminating light fixture 54 is comprised of a plurality of lamps 20, electrically conductive wire 56, and light enclosure tube 22. The light enclosure tube 22 is fixed within the downcomer tube 26 by support brackets 27. Electrical power is provided to both the light fixture 54 and the pump 38 by means of electrical connector 40 and electrical conduit 41.

The level 60 of the liquid 32 in the top enclosure 14 is maintained between enclosure top 12 and screen 18. The pump 38 is selected such that the flow rate of liquid 32 is adequate to cause the bed of particles 24 to be in a state of fluidization but not so large as to exceed the terminal velocity of said particles. The quantity of bed particles 24 placed in the top enclosure 14 is chosen so that the said particles do not extend to the top wall 12, even when the said particles are in a state of fluidization.

Arrows 53 indicate the direction of flow of liquid 32. In operation, the liquid 32 is pumped by pump 38 through the pump outlet tube 46, to the plenum chamber inlet 52, through the plenum chamber 34, through the distribution plate 30, through the enclosure tube 16 and bed of particles 24, through the enclosure expansion section 58, through the screen 18, through the downcomer tube 26, through downcomer tube outlet 50, and back to the pump through pump inlet tube 48.

The liquid 32 is chosen to give desired fluid-dynamic properties (such as viscosity and density) and desired optical properties (such as reflectivity and translucence). The preferred liquid is water. The size, density, shape, and optical characteristics of the bed of particles 24 are chosen to give desired flow pattern, visual and audible effect, and allowable liquid flow rate. The preferred particles are 4 mm diameter, spherical quartz glass beads.

The downcomer tube 26 is constructed out of at least partially transparent material to allow the illumination of the bed of particles 24 by the string of lights 54. The outside enclosure tube 14 is also at least partially transparent to allow observation of the fluidized bed of particles 24.

During operation, the fluidized bed lamp 10 exhibits a pleasing visual display through the chaotic motion of the fluidized bed of particles and through the illumination of the particles. Also, the lamp exhibits a pleasing audible display through the sound of particles colliding with one another and with the container walls.

While the above description contains many specificities, these should not be construed as limitations on the scope of the invention, but rather as an exemplification of one preferred embodiment thereof. Many other variations are possible, for example:

illumination could be provided at the top or bottom of the lamp instead of inside the downcomer tube illumination could be provided by a remote or detached lighting source the pump could be a submersible-type pump instead of one with an inlet tube connection the downcomer tube could be mounted externally from the main bed enclosure tube pump power could be provided by other than by electrical means Accordingly, the scope of the invention should be determined not by the embodiment illustrated, but by the appended claims and their legal equivalents.

I claim:

1. A fluidized bed lamp, comprising:

partially transparent first tube means containing a bed of particles;

plenum chamber means for directing a flow of liquid through said first tube;

pump means for causing said liquid to flow through said first tube, with the flow rate of said liquid sufficient to cause said bed of particles to be in a state of fluidization;

second tube means for returning said liquid flow back to inlet of said pump for recirculation;

means for illuminating said fluidized bed of particles.

2. The lamp of claim 1 wherein said illumination means includes lights fixed within said second tube means.

3. The lamp of claim 1 wherein said particles are glass beads with average diameters between about 0.1 mm and 10 mm.

4. The lamp of claim 1 wherein said liquid is water.

5. The lamp of claim 1 wherein said liquid is a mixture of water and colored dye.

* * * * *